US006089929A

United States Patent [19]

Sloey

[11] Patent Number: 6,089,929

[45] Date of Patent: Jul. 18, 2000

[54] HIGH AMPERAGE ELECTRICAL POWER CONNECTOR

[75] Inventor: Jason S. Sloey, Milpitas, Calif.

[73] Assignee: TVM Group, Inc., Fremont, Calif.

[21] Appl. No.: 09/136,087

[22] Filed: Aug. 18, 1998

[51] Int. Cl.[7] ..... H01R 13/187

[52] U.S. Cl. ..... 439/845

[58] Field of Search ..... 439/843, 844, 439/845, 846, 927

[56] References Cited

U.S. PATENT DOCUMENTS

| | | | |
|---|---|---|---|
| D. 366,239 | 1/1996 | Eaton | D13/146 |
| D. 366,241 | 1/1996 | Eaton | D13/147 |
| D. 366,454 | 1/1996 | Eaton | D13/147 |
| D. 368,071 | 3/1996 | Eaton | D13/147 |
| D. 372,220 | 7/1996 | Matthews | D13/133 |
| D. 372,222 | 7/1996 | Matthews | D13/154 |
| D. 405,417 | 2/1999 | Matthews | D13/147 |
| D. 408,361 | 4/1999 | Chau et al. | D13/147 |
| D. 408,789 | 4/1999 | Middlehurst et al. | D13/154 |
| D. 409,576 | 5/1999 | Wood et al. | D13/154 |
| 3,845,451 | 10/1974 | Neidecker | 439/845 |
| 4,662,706 | 5/1987 | Foley | 339/256 |
| 4,749,357 | 6/1988 | Foley | 439/80 |
| 4,824,380 | 4/1989 | Matthews | 439/78 |
| 4,854,899 | 8/1989 | Matthews | 439/724 |
| 5,055,055 | 10/1991 | Bakker | 439/78 |
| 5,124,883 | 6/1992 | Bakker | 361/386 |
| 5,431,576 | 7/1995 | Matthews | 439/247 |
| 5,575,690 | 11/1996 | Eaton | 439/717 |
| 5,575,691 | 11/1996 | Matthews | 439/744 |
| 5,591,039 | 1/1997 | Matthews | 439/181 |
| 5,676,571 | 10/1997 | Matthews | 439/843 |
| 5,807,120 | 9/1998 | Matthews | 439/80 |

*Primary Examiner*—Khiem Nguyen
*Assistant Examiner*—Javaid Nasri
*Attorney, Agent, or Firm*—Flehr Hohbach Test Albritton & Herbert LLP

[57] ABSTRACT

A high amperage female electrical power connector having a holder having a plurality of interlaced, overlapping parallel elongated contact members which are resiliently biased toward engagement with a male mating connector.

10 Claims, 3 Drawing Sheets

HIGH AMPERAGE ELECTRICAL POWER CONNECTOR

FIELD OF THE INVENTION

The present invention relates generally to electrical power connectors. More particularly, the invention concerns a high amperage electrical power connector used with rack-mounted electrical equipment.

BACKGROUND OF THE INVENTION

In conventional rack-mounted electrical equipment, a cabinet has vertically spaced rack mountings and a back. Modular components are supported by corresponding rack mountings so that the components can slide into and out of the cabinet. To provide electrical power to the modular components, the cabinet back typically includes one or more continuously powered bus bars and/or back planes. Each modular component normally includes one part of an electrical power connector assembly to effect electrical energization when the component slides into the cabinet; the cabinet itself carries the corresponding mating part of the electrical power connector assembly.

In the past a commonly used connector has been a clip-type female electrical power connector. Typically, a female power connector is attached to the surface or an edge of a backplane of a piece of electrical equipment, the back plane thus functions as a power supply. The equipment module is slid into a rack usually adjacent to several other pieces of equipment. A complementary male power connector attached to the back of the rack is inserted into a female connector on the back of the equipment module as the module is pushed into the rack. In some configurations, the female connector is attached to the back of the rack while the male connector is carried by the equipment module. In either configuration, the connecting procedure is the same.

Existing electrical power connectors are typically rated for relatively low amperage unless they are quite large because they do not have enough material volume or other means to properly accommodate or dissipate the heat generated in high amperage power connections.

SUMMARY OF THE INVENTION

The present invention provides an electrical power connector that accommodates high amperage connections in a relatively small footprint. An electrical power connector assembly in accordance with this invention includes an electrically conductive holder having a plurality of interlaced, overlapping parallel elongated contacts, each of which is resiliently biased toward engagement with a male mating connector. Preferably, the contacts are aligned in an electrically conductive band such that longitudinal axes of the contacts are aligned with the direction of relative movement between the connector elements. Each elongated contact is curved outwardly toward the male mating connector so that resilient contact elements are provided along opposed interior sides of the holder.

In accordance with one aspect of the invention there is provided an electrical power connector for connection with a mating connector in a high amperage power distribution system having an electrically conductive holder having two spaced opposing sides, each side have a plurality of interlaced, thin biased contacts.

In accordance with another aspect of the invention there is provided an electrical power connector for connecting to a mating connector in a power distribution system having a holder having two spaced opposing sides, the two opposing sides each having a first electrically conductive strip and a second electrically conductive strip having a plurality of resilient contact members with openings therebetween overlaying the first electrically conductive strip with a plurality of resilient contact members of the first electrically conductive strip extending through the openings between the resilient contact members of the second conductive strip.

BRIEF DESCRIPTION OF THE DRAWINGS

Many objects and advantages of the present invention will be apparent to those skilled in the art when this specification is read in conjunction with the attached drawings wherein like reference numerals are applied to like elements and wherein.

DETAILED DESCRIPTION OF THE PREFERRED EMBODIMENTS

Figure 6:
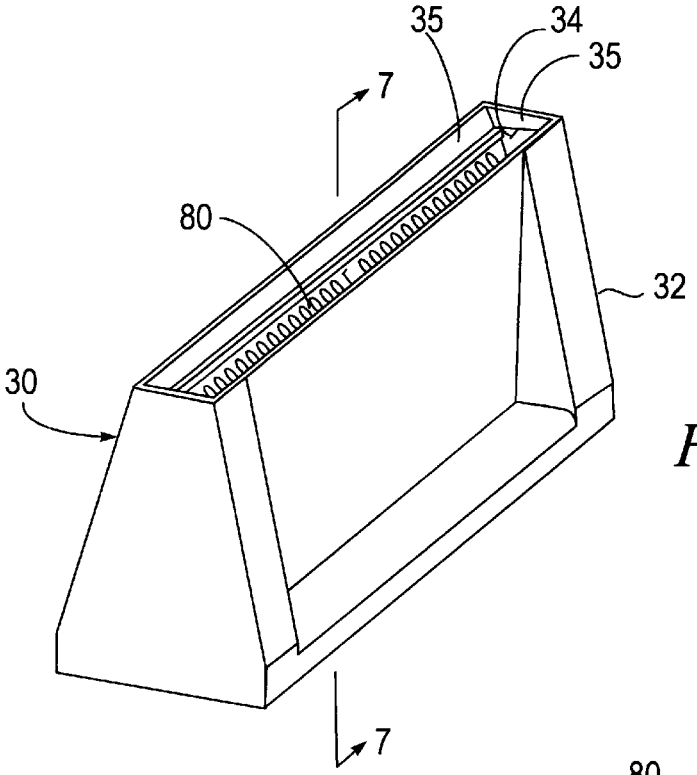
FIG. 6 is a perspective view of an electrical power connector and housing in accordance with the present invention.
Figure 7:
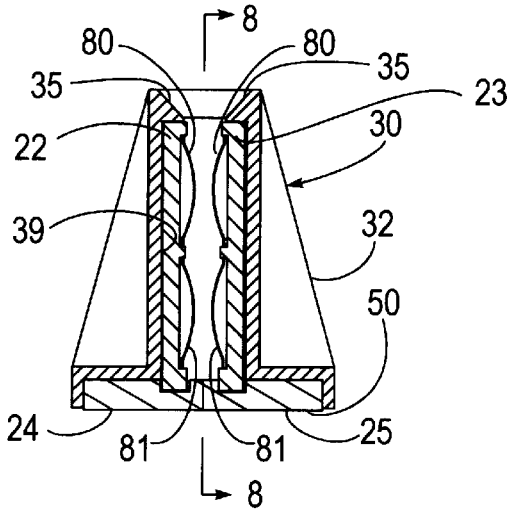
FIG. 7 is a cross-sectional view taken along the line 7—7 of FIG. 6 showing internal characteristics of the electrical power connector.
Figure 8:
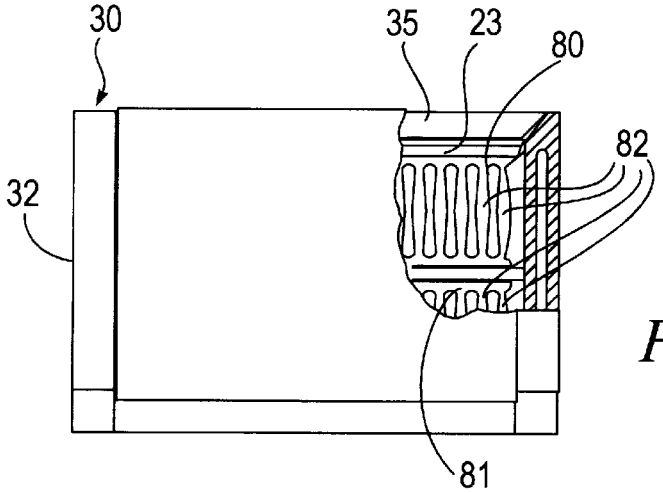
FIG. 8 is a partial cross-sectional view taken alone, the line 8—8 of FIG. 7 showing further characteristics of internal features of the electrical power connector.

An electrical power connector assembly for use in a power distribution system generally includes a plug portion or a male mating connector (not shown) and a receptacle portion or female mating connector 30 (FIGS. 6–8). The principal characteristics of the plug portion are the presence of an electrically conductive blade member having predetermined width, predetermined thickness, and predetermined length. The width and thickness of the blade member are proportioned so that the rated current and voltage can be safely transmitted. The length is selected so that the blade will be fully received within the mating receptacle portion 30 without exposing electrically conducting portions thereof to casual contact during use and/or maintenance. The end portion of the blade typically is rounded. That rounded end facilitates coupling of the plug portion and the receptacle portion 30 in which electrical contact elements protrude so that lateral clearance is less than the predetermined thickness.

The receptacle portion 30 of the present invention is a high amperage female electrical power connector that is capable of carrying 525 amps, preferably up to about 600 amps, with a relatively small footprint. The receptacle portion 30 has within the housing 32 a holder 50 (FIGS. 1–5) that has a base 20 with a length of about 1.9 inches and a width of about 1.1 inches. There are two uprights 22 and 23 extending upward from the base 20 such that the holder 50 has an overall height of about 1.4 inches. The base 20 has openings 21 therethrough to accommodate rivets, screws or other fasteners for attaching the receptacle portion 30 to a bus bar or equipment module.

In one embodiment, the upright 22 and flange 24 are machined from a piece of highly electrically conductive material, such as copper, and upright 23 and flange 25 are machined from a piece of highly electrically conductive material, such as copper. The uprights and flanges can be also extruded. The flanges 24 and 25 are than brazed together to form base 20 and holder 50. In a preferred embodiment, the flanges are brazed together in a location between the uprights (see line 26). In this manner, the current flowing through the uprights 22 and 23 on each side of the receptacle portion 30 does not have to pass through the joint 26.

Figure 9:
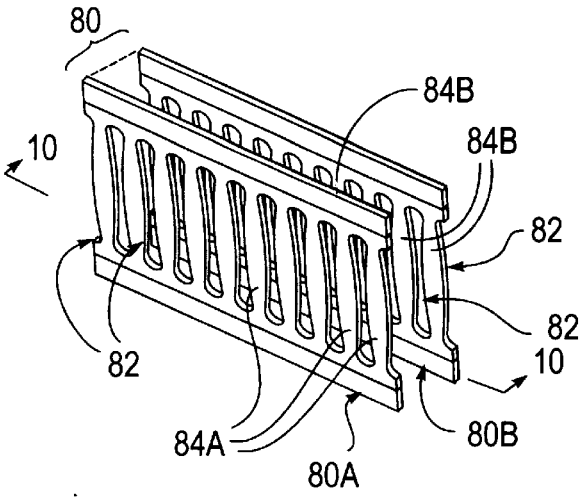
FIG. 9 is an exploded perspective view of interlaced, overlaying contact strips.
Figure 11:
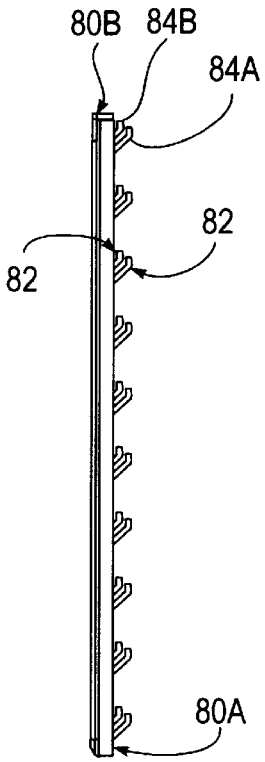
FIG. 11 is a side view of the contact strips of FIG. 10 taken along the line 11—11 of FIG. 10.

The holder 50 accommodates two rows of interlaced, overlaying contact strips 80 and 81 (FIGS. 7 and 8) on each side of the holder 50. In order to carry the high amperage required by the electrical power connector of the present invention without increasing the length or height of the holder 50, each row of contact strips 80 and 81 is comprised of a pair of interlaced, overlapping contact strips, for example 80A and 80B in FIG. 9. The configuration of the strips are described with reference to strip 80, but the description is applicable to strip 81 as well. Contact strip 80A overlays 80B such that edge portions or edges 84*b* of the contact members 82 of the contact strip 80B are interlaced with the contact strip, the contact members 82 of the contact strip 80A. In other words, the contact edges 84B extend through the openings between the contact members 82 of contact strips 80A when strips 80A and 80B are brought into contact. With the contact strips overlayed and the contact members interlaced, twice as many contact members are placed in a given length (i.e., higher density of contacts) of the holder without the increased manufacturing costs or difficulties in producing a single contact strip having a higher density of contact members. In addition, the overlayed contact strips provide about twice the volume of material for handling the high amperage current without the increased manufacturing costs or difficulties in producing a thicker contact strip having the necessary volume of material in a given length and width. With the two rows of interlaced, overlayed contact strips on each side of the holder 50, there are eight contact strips (like 80A) in the holder 50 so as to achieve about a 40% higher current carrying capacity over a holder having only a single contact strip like 80A on each side such as described in U.S. Pat. No. 5,431,576 or an even greater percentage increase over a conventional electrical power connector not having compliant contact strips. Also in order to carry the high current from the contact strips 80 and 81 to a busbar from which the electrical power connector is mounted, the holder 50 is a thick conductive copper member having a base 20 having a thickness of about 0.16 inches and uprights 22 and 23 having a thickness of about 0.12 inches so as to provide a holder having the least constriction and an appropriate cross-sectional area as a path through the holder 50 to accommodate 525 amps, preferably up to about 600 amps, without failure or excessive heat build up in the holder.

The receptacle portion 30 of the electrical power connector includes an optional but preferred housing 32 (see FIGS. 6–8). The housing 32 has a centrally positioned, generally rectangular opening 34 for receiving the male mating connector portion (not shown). The length of the opening 34 is selected to be larger than the predetermined length of the mating connector portion and to have a width greater than the thickness of the mating connector portion. Access and guidance toward the opening 34 are facilitated by four inclined or tapered side cam surfaces 35 which slope inwardly from the distal end of the housing 32 to the peripheral edge of the opening 34. The side surfaces 35 are inclined with respect to the longitudinal axis of the housing 32 by an angle which is less than 45 degrees. In particular, the angle of the inclined side surfaces is selected so that the surfaces function as cam surfaces to guide the male portion of the connector into the opening 34 without friction locking. In normal operation, if the male mating connector is slightly misaligned from the opening 34 in the receptacle portion 30 of the power connector, the tapered sides 35 cause relative positional adjustment between the male mating connector and the receptacle portion 30 of the power connector. The housing 32 is preferably fabricated of a polyester, flame retardant plastic (PET) but other materials such as any rigid thermoset or thermoplastic may be used. It is of course important that the housing material be an electrical insulator in order to reduce the possibility of electrical shock hazard. The housing 32 has an internal cavity sized and configured to receive, retain, and substantially surround the electrically conductive holder 50 (FIGS. 7 and 8). The internal cavity is open to the proximate end of the housing 32 and extends through the housing 32 so as to communicate with the opening 34. The cavity 39 has a width which exceeds the width of the opening 34 so that the mating connector portion can be received in the holder 50 which is located in the cavity 39. It is within the scope of the present invention that multiple holders 50 can be coupled together under a single housing to produce corresponding multiples of high amperage capacity connectors.

Figure 1:
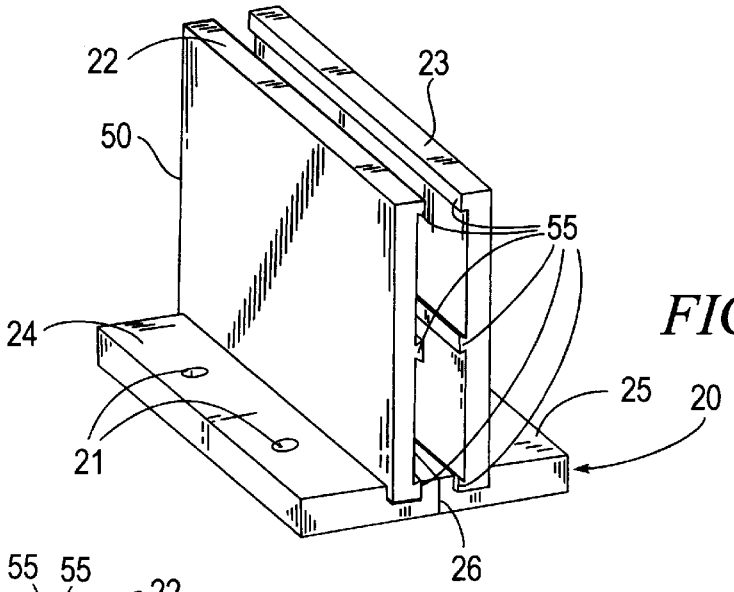
FIG. 1 is a perspective view of a holder of an electrical power connector in accordance with the present invention.
Figure 2:
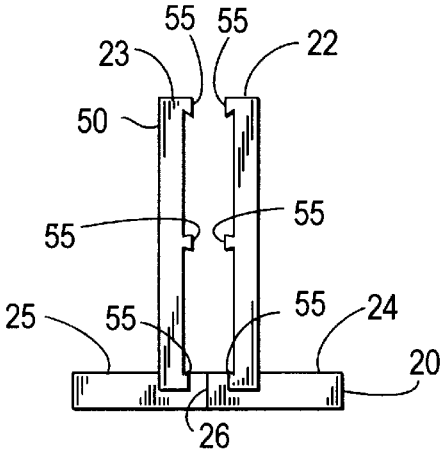
FIG. 2 is a left-side elevational view of the holder shown in FIG. 1.
Figure 3:
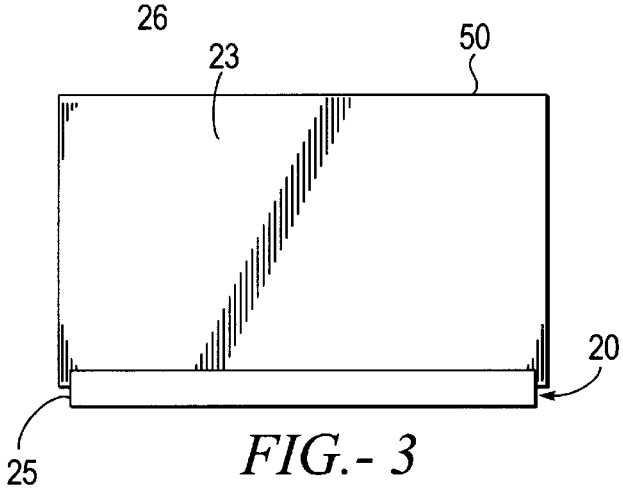
FIG. 3 is a rear elevational view of the holder.
Figure 4:
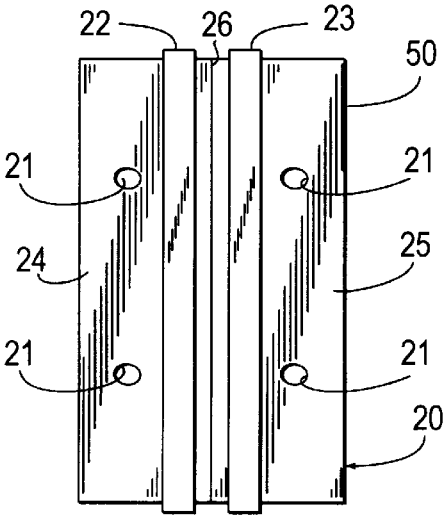
FIG. 4 is a top plan view of the holder.
Figure 5:
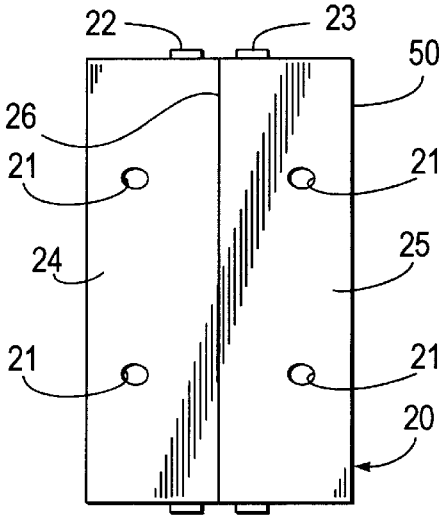
FIG. 5 is a bottom plan view of the holder.

The pair of opposing generally planar uprights 22 and 23 are connected at one end, the mounting end, through the base 20 and are spaced from one another at the other end, the receiving end, at a distance greater than the width of the opening 34 and define a slot therebetween. As mentioned above, each upright 22 and 23 of the holder 50 is provided with a plurality of interlaced, overlayed electrically conducting contact strips 80 and 81 having a plurality of contact members 8 (FIGS. 9 and 10) extending along an axis from the distal end to the proximal end in the housing. To position and attach the pairs of contact strips 80 and 81 to the associated uprights 22 and 23, the corresponding side has a retaining means such as a plurality of clips or rails 55 (FIGS. 1 and 2). Each rail 55 is integral with the material of the holder 50. The rails 55 are arranged in two rows spaced to correspond to the height of each strip 80 and 81. When each strip 80 and 81 is positioned between the respective rails 55, the rails are in contact with the edges of each of the strips 80 and 81 to secure it in position and in electrical contact with the associated uprights 22 and 23.

Figure 10:
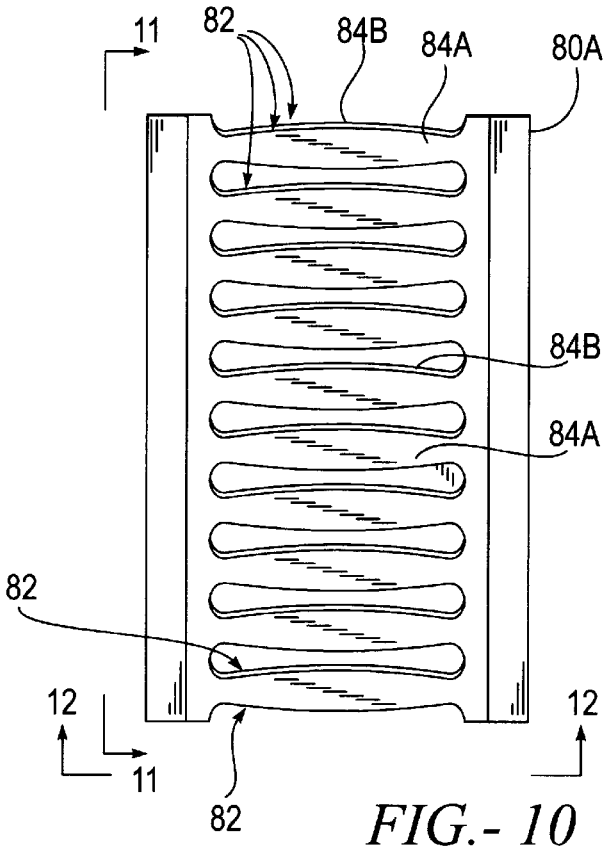
FIG. 10 is an enlarged plan view of the contact strips of FIG. 9, after nesting, taken along the 9—9 of FIG. 9.
Figure 12:
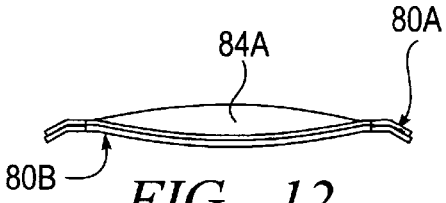
FIG. 12 is an end view of the contact strips of FIG. 10 taken along the line 12—12 of FIG. 10.

Each strip 80A, 80B, 81A, and 81B has a multiplicity of curved, resilient crown contact members 82 (FIG. 10). Each contact member 82 has a reduced width portion adjacent to the top and bottom edge of the strip, as well as a formed edge edge portion or 84 which is deformed rearwardly so that the contact member 82 presents a contact that is arcuate in both longitudinal and transverse cross section. The reduced width portions at each end function as torsional springs when the contact member 82 is deflected and thus resiliently bias the contacts toward a contact position. When the strips 80 and 81 are attached to the associated upright 22 and 23 of the holder 50, the contact elements 82 protrude farther into the slot defined by the uprights than does the distal end of each upright. The resilient contact members 82 provide the electrical connection between the receptacle portion 30 of the power connector and male mating connector. Each strip 80A, 80B, 81A, and 81B is preferably composed of heat-treatable grade beryllium-copper alloy, but it is contemplated that it may be composed of other electrically conductive metals such as phosphor-bronze, brass, stainless steel, etc. The use of a multiplicity of interlaced resilient contact members 82 is advantageous because the large number of contacts produce a higher amperage connector, having improved electrical conductivity, lower voltage drop, and lower power consumption.

It will now be apparent that the present invention overcomes the problems and deficiencies associated with prior devices. Moreover, it will now be apparent to those skilled in the art that various modifications, variations, substitutions, and equivalents exist for various elements of the invention but which do not materially depart from the spirit and scope of the invention. Accordingly, it is expressly intended that all such modifications, variations, substitutions and equivalents which fall within the spirit and scope of the invention as defined by the appended claims be embraced thereby.

The invention claimed is:

1. An electrical power connector for use with a male connector in a high amperage power distribution system, comprising an electrically conductive holder having a recess adapted to receive the male connector, first and second juxtaposed strip-like members mounted to the conductive holder within the recess, each of the first and second strip-like members being provided with thin biased contacts extending into the recess for electrically engaging the male connector, the thin biased contacts of the first strip-like member being interlaced with the thin biased contacts of the second strip-like member to enhance the electrical connection between the conductive holder and the male connector.

2. The electrical power connector of claim 1 wherein each of the thin biased contacts is a resilient element that is resiliently biased toward a contact position for engaging the male connector.

3. The electrical power connector of claim 1 wherein the first strip-like member is parallel to the second strip-like member.

4. An electrical power connector for use with a male connector in a power distribution system, comprising an electrically conductive holder having first and second spaced-apart opposing side walls forming a recess adapted to receive the male connector, first and second electrically conductive strips mounted on each of the first and second walls within the recess, the first strip overlaying the second strip, each of the first and second strips being formed with a plurality of spaced-apart resilient contact members with openings therebetween, the contact members of the first strip extending through the openings between the contact members of the second strip whereby the contact members of the first and second strips electrically are engagable with the male connector.

5. The electrical power connector of claim 4 further comprising third and fourth electrically conductive strips mounted on each of the first and second walls below the first and second strips, the third strip overlaying the fourth strip, each of the third and fourth strips being formed with a plurality of resilient contact members with openings therebetween, the contact members of the third strip extending through the openings between the contact members of the fourth strip whereby the contact members of the third and fourth strips electrically are engagable with the male connector.

6. An electrical power connector for use with a male connector in a power distribution system, comprising a rigid base plate of an electrically conductive material and first and second spaced-apart rigid wall plates of an electrically conductive material joined to the base plate and extending upwardly from the base plate for forming a recess adapted to receive the male connector, a first strip having a plurality of longitudinally spaced-apart first thin contact members of an electrically conductive material and a second strip having a plurality of longitudinally spaced-apart second thin contact members of an electrically conductive material, first means for mounting the first strip on the first wall plate and second means for mounting the second strip on the second wall plate so that the first contact members oppose the second contact members whereby the first and second contact members extend into the recess for electrically contacting the male connector.

7. The electrical power connector of claim 6 further comprising a third strip having a plurality of longitudinally spaced-apart thin contact members of an electrically conductive material overlaying the first strip so that the contact members of the first strip are longitudinally interlaced with the contact members of the third strip and a fourth strip having a plurality of longitudinally spaced-apart thin contact members of an electrically conductive material overlaying the second strip so that the contact members of the second strip are longitudinally interlaced with the contact members of the fourth strip.

8. The electrical power connector of claim 6 wherein the first and second means each include first and second spaced-apart rails provided on the respective wall plate, each of the first and second strips being slidably disposed between the respective first and second rails.

9. The electrical power connector of claim 6 wherein the base plate and the first and second wall plates are each made of copper.

10. The electrical power connector of claim 6 wherein the first and second strips are each made from a beryllium-copper alloy.

* * * * *